United States Patent [19]

Knowles

[11] 4,021,052

[45] May 3, 1977

[54] LAND SKI APPARATUS

[76] Inventor: Lloyd C. Knowles, 43 Front St., Hopkinton, Mass. 01748

[22] Filed: Apr. 21, 1976

[21] Appl. No.: 678,865

[52] U.S. Cl. ..... 280/11.2; 280/11.1 BT; 280/11.21

[51] Int. Cl.[2] ..... A63C 17/14; A63C 17/04

[58] Field of Search ..... 280/11.2, 11.21, 11.23, 280/11.1 BT, 11.19, 87.04 A, 87.04 R, 7.13, 615, 609

[56] References Cited

UNITED STATES PATENTS

| | | | |
|---|---|---|---|
| 805,942 | 11/1905 | Beals | 280/11.2 |
| 914,458 | 3/1909 | Rieger | 280/11.2 |
| 1,247,801 | 11/1917 | Egge | 280/11.2 X |
| 2,253,012 | 8/1941 | Benner et al. | 280/11.19 X |
| 2,403,885 | 7/1946 | Thompson | 280/7.13 |
| 3,481,618 | 12/1969 | With | 280/615 |
| 3,622,172 | 11/1971 | Goodwin | 280/11.2 |

FOREIGN PATENTS OR APPLICATIONS

| | | | |
|---|---|---|---|
| 554,954 | 3/1923 | France | 280/11.19 |
| 1,136,599 | 12/1956 | France | 280/11.1 BT |

*Primary Examiner*—Joseph F. Peters, Jr.
*Assistant Examiner*—Milton L. Smith
*Attorney, Agent, or Firm*—William Nitkin

[57] ABSTRACT

A land ski device comprised of a pair of ski members each having a front wheel, a reverse braking member, means for affixing the toe portion of the user's boot to the ski member, two rear wheels located at the point of balance of the ski member, and a rear stationary braking member located at the bottom rear of the ski member.

12 Claims, 3 Drawing Figures

LAND SKI APPARATUS

BACKGROUND OF THE INVENTION

1. Field of the Invention

The device of this invention resides in the area of cross country ski equipment.

2. Description of the Prior Art

Cross country skiing has been practiced in Nordic countries for many hundreds of years and has recently gained in popularity in this country. Due to the climate of the U.S. the cross country skiing season is rather short and lasts for about four months. Since cross country skiing requires great stamina and good physical condition, it is advantageous for an individual who wishes to participate in this sport during the winter months to practice the basic touring stride during the off season. In cross country skiing the basic touring stride is a kick-off from one foot and a gliding step with the other. Kick-offs and glides are alternated between one foot and the other to give a smooth rhythmical stride on snow. On snow there are several means of maintaining forward movement and minimizing rearward slippage. The proper application of wax on the bottom of the skis will enable the skis to glide forward and will also maintain rearward grip against the snow. Recently cross country skis have been developed incorporating ridges and fish scale designs on the bottom of the skis to permit forward movement and hinder rearward movement.

There is presently a device on the market which duplicates some of the functions of cross country skis but which has wheels on its lower portion. This device commonly known as a skate board has roller skate-type wheels affixed to the bottom of the board. These skate boards differ from cross country skis in that they have little means of control and are utilized one at a time.

At present those engaged in cross country skiing who wish to condition themselves during the off season must do strenuous exercises such as running long distances, running short distances, running long and short distances, running uphill, and performing specific exercises for building up their leg muscles such as bicycling on bicycles which have resistance added to the movement of the pedals. One can also run with ski poles on land to imitate the basic touring stride and diagonal strides that one would use while cross country skiing. A program of exercise such as described above would only be maintained by serious students of cross country skiing. It is felt that the device of this invention which can be used to practice the basic touring strides of cross country skiing can add enjoyment to the exercise and muscular conditioning necessary for successful cross country skiing.

SUMMARY

The device of this invention is a dry land ski apparatus to be utilized in a pair, one for each foot, each ski member having a front wheel and a pair of rear wheels affixed thereto and means for engaging a land skier's boot in such a manner as to leave the heel of that boot free for upward movement while in use. Further included in the device of this invention is a reverse braking member located to the front of the user's boot to prevent rearward movement of the ski member. The positioning of the pair of rear wheels on each ski member is such that the point of balance of the apparatus is near the center of the individual's boot. A rear stationary braking member is affixed to the bottom rear of each ski member which, if the individual using the skis leaned back on the ski members, would cause the point of balance to shift causing the rear stationary braking members to make contact with the ground thereby stopping or slowing the skis depending on the wishes of the user. In one embodiment a three-pin boot binding is utilized which pins engage into holes at the base of the front of each of the user's boots.

The device of this invention is used in a similiar manner as cross country skis would be used on snow. The reverse braking member which extends through the apparatus of this invention at an angle has a limited range of movement and is unaffected by forward movement and bounces along the ground as the land ski rolls forward. If there should be rearward movement, the reverse braking member would catch the ground and prevent backward movement of the ski. The front wheel of the ski member can extend through the ski member and can be a single wheel. The rear wheels can utilize ball bearings or equivalent freely spinnable wheels and are located below the individual's boot contact area. These rear wheels can consist of two wheels, one located to each side of the ski member to add stability to the ski member when it is in use. The rear stationary braking member located to the rear and affixed to the bottom of the ski member and extending below it, makes frictional contact with the ground when the user leans back on the skis.

A further embodiment of this device can have the rear portion behind the boot contact area of the ski member narrowed. This embodiment is particularly advantageous when an individual wishes to stop quickly as he can lean back in a squatting position and easily grasp the narrowed rear portion of the skis, thereby applying his entire body weight over the rear stationary braking members of his skis which action quickly stops forward movement of the skies.

It is therefore an object of this invention to provide a cross country skier with means for practicing the basic touring strides on dry land all year round. The device of this invention provides means for stopping forward movement and will not permit backward slippage on dry land as the skier moves forward. It is a further object of this invention to provide an inexpensive land skiing device which would add enjoyment to a program of exercise and muscular buildup necessary for successful cross country skiing. This device can also be enjoyed by all age groups for general sport and body conditioning and its use is not limited to cross country skiinng enthusiasts.

DESCRIPTION OF THE PREFERRED EMBODIMENT

Figure 1:
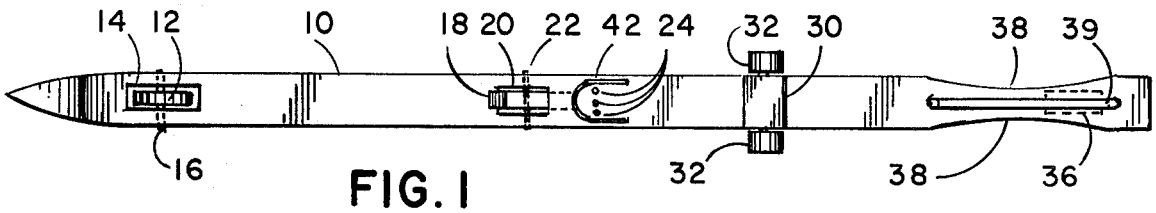
FIG. 1 illustrates a top view of the land ski apparatus of this invention.

In FIG. 1 a top view of the land ski of this invention is shown. In practice one would use two individual skis of the type shown, placing one on each foot. Ski member 10 has the general shape of a snow ski and can be constructed from a fabricated snow ski, wood, or equivalent material having sufficient strength to withstand the vibrations and rigors of dry land skiing where more bumps and a stiffer ride are encountered due to the irregular surface of the ground as opposed to the smooth surface of snow. Front wheel 12 is located within aperture 14 of ski member 10. Axle 16 extends through ski member 10 and is journaled to the ski member. In one embodiment wheel member 12 can utilize ball bearings for ease of movement. The device of this invention utilizes a braking mechanism for the prevention of rearward movement. Pivotal shaft 22 is inserted through reverse braking member 18 within braking receptacle aperture 20. A further explanation of the mechanism and function of reverse braking member 18 can be found in the description of FIG. 2. The front of the skier's boot is held in position by toe guard 42. In the embodiment illustrated in FIG. 1, three pins 24 are shown which engage into three receptacle pin slots 26 located in the user's boot and which are illustrated in FIG. 3. The wearer's boot rests on boot rest member 30 which is positioned approximately over rear wheels 32 which are affixed to ski member 10 in a similar manner as front wheel 12. Further seen in FIG. 1 is narrowed rear portion 38 of ski member 10 which shape can assist the ski user in quickly stopping forward movement of the skis when he squats and leans back to grasp the circumference of narrowed rear portion 38 thereby applying all his body weight over rear stationary braking member 36 to cause increased drag of that member against the ground.

Figure 2:
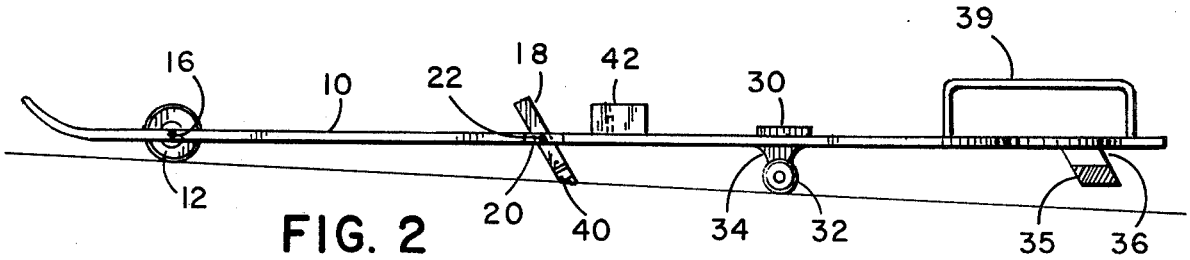
FIG. 2 illustrates a side view of the land ski apparatus of this invention.
Figure 3:
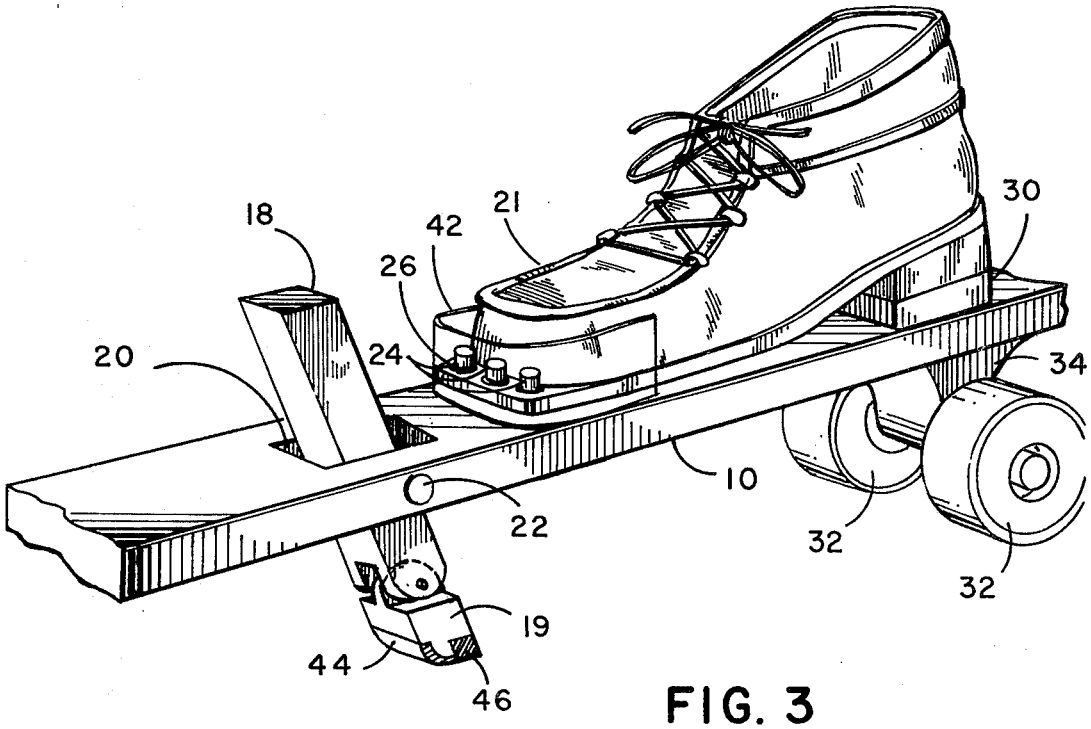
FIG. 3 is an enlarge sectional view of the apparatus of this invention illustrating the boot area and the reverse braking member of the ski member.

FIG. 2 illustrates a side view of the land ski apparatus of this invention. Shown are front wheel 12 and reverse braking member 18 inserted into braking receptacle aperture 20. Aperture 20 allows reverse braking member 18 to pivot on pivotal shaft 22 within aperture 20 in a limited range of movement of approximately 45° from the position of the brake in its forward full-braking position and the position of the brake as it rides forward along the ground. In use, as ski member 10 moves forward, reverse braking member 18 rides over the ground with some up and down motion. However, should the ski member start to move in a rearward direction, the lower tip of reverse braking member 18 makes contact with the ground at point 40 and twists on its axis within braking receptacle aperture 20 until the reverse braking member is perpendicular to the ground thereby preventing rearward movement by its contact with the ground. It is important that reverse braking member 18 stop firmly when it is perpendicular to the ground so as to prevent rearward movement. Reverse braking member 18 can have tip member 42 illustrated in FIG. 3 pivotally attached to pivot member 19 at its end for greater braking efficiency. Tip member 42 can be comprised of two members: forward-facing member 44 which can be covered with steel, nylon or equivalent durable material; and ground-facing member 46 which can be covered with rubber or other resilient material. Both forward-facing member 44 and ground-facing member 46 can be replaced individually as they are worn down by wear. Rear wheels 32 can have extensions 34 to place them somewhat lower than front wheel 12 to create a point of balance such that when the user rests his weight upon his heels, rear stationary braking member 36 makes contact with the ground thereby stopping forward movement of the ski member. Rear stationary braking member 36 can be constructed of wood, steel, or other durable material and can have resilient base 35 composed of rubber or equivalent material for frictional adherence to the ground. Resilient base 35 can be replaced as it is worn down by use. In a further embodiment illustrated in FIG. 2, hand rail 39 positioned on the upper rear portion of each ski member can be grasped by the user to add further weight to rear stationary braking member 36. This embodiment can be used by those not having the agility to grasp narrowed rear portion 38 of the ski member illustrated in FIG. 1.

FIG. 3 illustrates an enlarged sectional veiw of the center portion of ski member 10 with boot 21 in position between toe guard 42 and boot rest member 30. Further seen are receptacle pin slots 26 for the engagement of pins 24 which extend up from ski member 10 for the toe engagement of boot 21 leaving the boot heel free for upward movement. Also seen in FIG. 3 is toe guard 42 which prevents both lateral and forward movement of the boot. Toe guard 42 can be constructed of plastic or other stiff material suitable for ski boot binding. Rear wheels 32 on mounting extensions 34 extend below boot rest member 30. Seen in this view is tip member 19 pivotally mounted on the end of reverse braking member 18. Forward-facing member 44 and ground-facing member 46 of tip member 19 are also seen in this view.

Although the present invention has been described with reference to particular embodiments, it will be apparent to those skilled in the art that variations and modifications can be substituted therefor without departing from the principles and spirit of this invention.

I claim:

1. A land ski device comprising:

a pair of ski members each having a front, central, and rear portion;

a front wheel journaled to the front portion of each of said ski members;

a reverse braking member pivotally attached in an aperture defined within the central portion of said ski member;

means for releasably attaching a user's ski boot to the upper central portion of each of said ski members;

a support member affixed to the central bottom portion of each of said ski members;

a rear wheel journaled to said support member; and a rear stationary braking member affixed to the bottom rear portion of each of said ski members.

2. A device as recited in claim 1 wherein in addition to said rear wheel is a second rear wheel parallel to and on the same axle as said first rear wheel affixed in like manner as said first rear wheel.

3. A device as recited in claim 2 wherein a portion of said front wheel rotates within an aperture defined within the front portion of each of said ski members.

4. A device as recited in claim 3 wherein said reverse braking member's pivotal movement is controlled within a 45° range by the front and rear boundaries of said reverse braking member's aperture.

5. A device as recited in claim 4 wherein said means for releasably attaching a user's ski boot to the upper central portion of each of said ski members comprises three prongs extending from the upper central portion of each of said ski members for insertion into three receptacle slots located on the sole extension of each of said user's ski boots.

6. A device as recited in claim 5 wherein the lowest point on the circumference of each of said rear wheels is farther from the bottom of the ski member than the lowest point on the circumference of said front wheel.

7. A device as recited in claim 6 wherein said means for releasably attaching a user's ski boots is attached over the center of balance of each of said ski members.

8. A device as recited in claim 7 wherein said rear portion of each of said ski members is substantially narrower than the front and central portion of each of said ski members.

9. A device as recited in claim 8 wherein said rear stationary braking member has a removable resilient base member.

10. A device as recited in claim 9 further including a tip member pivotally attached to the lower end of said reverse braking member.

11. A device as recited in claim 10 wherein said tip member further includes:

a durable member removably affixed to the front of said tip member; and a resilient member removably affixed to the rear bottom of said tip member.

12. A device as recited in claim 11 further including a hand rail located on the upper rear portion of each of said ski members.

* * * * *